US010926129B2

(12) United States Patent
Yoo

(10) Patent No.: US 10,926,129 B2
(45) Date of Patent: Feb. 23, 2021

(54) TREADMILL AND FRAME STRUCTURE THEREOF

(71) Applicant: DRAX INC., Anyang-si (KR)

(72) Inventor: Seon Kyung Yoo, Seoul (KR)

(73) Assignee: DRAX Inc., Gyeonggi-do (KR)

( * ) Notice: Subject to any disclaimer, the term of this patent is extended or adjusted under 35 U.S.C. 154(b) by 44 days.

(21) Appl. No.: 16/221,228

(22) Filed: Dec. 14, 2018

(65) Prior Publication Data

US 2019/0118030 A1 Apr. 25, 2019

Related U.S. Application Data

(63) Continuation of application No. PCT/KR2017/006334, filed on Jun. 16, 2017.

(30) Foreign Application Priority Data

Jun. 16, 2016 (KR) ..... 20-2016-0003391
May 2, 2017 (KR) ..... 10-2017-0056264

(51) Int. Cl.
*A63B 22/02* (2006.01)
*A63B 22/00* (2006.01)
*A63B 22/20* (2006.01)

(52) U.S. Cl.
CPC ..... *A63B 22/02* (2013.01); *A63B 22/0046* (2013.01); *A63B 22/0285* (2013.01); *A63B 2022/206* (2013.01)

(58) Field of Classification Search
CPC . A63B 22/02; A63B 22/0285; A63B 22/0046; A63B 2022/206; A63B 69/0028
See application file for complete search history.

(56) References Cited

U.S. PATENT DOCUMENTS 6,923,746 B1 * 8/2005 Skowronski ..... A63B 22/0023 482/51
2003/0130095 A1 * 7/2003 Hellman, Jr. ..... A63B 22/0285 482/54

(Continued)

FOREIGN PATENT DOCUMENTS

JP 2013-226173 A 11/2013
KR 10-1410325 B1 6/2014
WO 2013/084757 A1 6/2013

OTHER PUBLICATIONS

Office Action of corresponding Korean Patent Application No. 10-2017-0056264—8 pages (dated Dec. 20, 2017).

(Continued)

*Primary Examiner* — Jennifer Robertson
*Assistant Examiner* — Andrew M Kobylarz
(74) *Attorney, Agent, or Firm* — Knobbe Martens Olson & Bear LLP

(57) ABSTRACT

Provided is a treadmill including a frame structure supporting both ends of each of a plurality of slats to allow the plurality of slats to be movable. The frame structure includes a first frame and a second frame arranged parallel to each other with a distance therebetween, a first side frame and a second side frame respectively arranged outside the respective first and second frames, and a plurality of horizontal bars having a length greater than the distance. Each of the plurality of horizontal bars includes a first load region between the first frame and the second frame, a second load region overlapping the first side frame and fixed to the first side frame, and a third load region overlapping the second side frame and fixed to the second side frame.

21 Claims, 7 Drawing Sheets

(56) References Cited

U.S. PATENT DOCUMENTS

| | | | | |
|---|---|---|---|---|
| 2008/0020907 | A1* | 1/2008 | Lin | A61H 1/005 482/54 |
| 2014/0011642 | A1* | 1/2014 | Astilean | A63B 22/02 482/54 |
| 2014/0080679 | A1* | 3/2014 | Bayerlein | A63B 22/0017 482/54 |
| 2015/0210348 | A1 | 7/2015 | Astilean | |
| 2016/0144224 | A1 | 5/2016 | Dalebout et al. | |
| 2016/0166877 | A1 | 6/2016 | Cei et al. | |
| 2016/0199695 | A1* | 7/2016 | Armstrong | A63B 22/0235 482/8 |

OTHER PUBLICATIONS

Office Action of corresponding Korean Patent Application No. 20-2016-0003391—7 pages (dated Feb. 16, 2017).

Notice of Allowance of corresponding Korean Patent Application No. 10-2017-0056264—2 pages (dated Aug. 30, 2018).

International Search Report dated Aug. 30, 2017 in corresponding International Application No. PCT/KR2017/006334.

* cited by examiner

TREADMILL AND FRAME STRUCTURE THEREOF

CROSS-REFERENCE TO RELATED APPLICATIONS

This application is a continuation application, and claims the benefit under 35 U.S.C. §§ 120 and 365 of PCT Application No. PCT/KR2017/006334, filed on Jun. 16, 2017, which is hereby incorporated by reference. PCT/KR2017/006334 also claimed priority from Korean Patent Application Nos. 20-2016-0003391 filed on Jun. 16, 2016 and 10-2017-0056264 filed on May 2, 2017 both of which are hereby incorporated by reference.

BACKGROUND

Technical Field

The present disclosure relates to a treadmill and a frame structure thereof.

Related Technology

Treadmill are exercise machines that give the effect of walking or running exercise in a small space using a belt rotating along an infinite orbit, and are also called running machines. The demand for treadmills is ever increasing because treadmills allow users to walk or run indoors at suitable temperatures, regardless of the weather.

Treadmills may be classified into automatic treadmills in which a belt is rotated by a separate driving means and manual treadmills in which a belt is rotated by a user's motion without a separate driving means.

Since manual treadmills do not need a separate driving means, manual treadmills are much cheaper than automatic treadmills and the size and weight of manual treadmills are much smaller than automatic treadmills. Recently, there has been increasing demand for such manual treadmills.

SUMMARY

Provided are a treadmill and a frame structure thereof, by which a user's load may be effectively transferred to the outside when the user uses the treadmill.

According to an aspect of the present disclosure, a treadmill includes a plurality of slats extending in a first direction and arranged in a second direction perpendicular to the first direction; and a frame structure supporting both ends of each of the plurality of slats to allow the plurality of slats to be movable in the second direction, wherein the frame structure includes a first frame and a second frame arranged parallel to each other with a distance therebetween in the first direction; a first side frame arranged outside the first frame; a second side frame arranged outside the second frame; and a plurality of horizontal bars extending in the first direction and having a length greater than the distance, wherein each of the plurality of horizontal bars includes a first load region between the first frame and the second frame; a second load region overlapping the first side frame and fixed to the first side frame; and a third load region overlapping the second side frame and fixed to the second side frame.

Each of the first and second side frames may include an opening through which each of the plurality of horizontal bars passes.

The plurality of horizontal bars may be fixed to the first and second side frames using welding.

The first and second side frames may respectively include positioning members setting a position of the second load region and a position of the third load region.

A top portion of each of the first and second frames may have a concave curved shape, and the treadmill may further include a plurality of bearings along the concave curved shape in each of the first and second frames.

The treadmill may further include a first belt connecting respective one ends of the plurality of slats, the first belt being moved by the plurality of bearings in the first frame; and a second belt connecting respective opposite ends of the plurality of slats, the second belt being moved by the plurality of bearings in the second frame.

The treadmill may further include a first side cover covering the first side frame and a second side cover covering the second side frame.

The plurality of slats may be moveable by a user's foot motion.

According to another aspect of the present disclosure, a frame structure of a treadmill, which supports a user's load, includes a first frame and a second frame arranged parallel to each other with a distance therebetween; a first side frame arranged outside the first frame; a second side frame arranged outside the second frame; and a plurality of horizontal bars extending perpendicularly to the first and second frames and having a length greater than the distance, wherein each of the plurality of horizontal bars includes a first load region between the first frame and the second frame; a second load region overlapping the first side frame and fixed to the first side frame; and a third load region overlapping the second side frame and fixed to the second side frame.

Each of the first and second side frames may include an opening through which each of the plurality of horizontal bars passes.

A top portion of each of the first and second frames may have a concave curved shape.

The frame structure may further include a front roller connector in a front end of each of the first and second frames, the front roller connector being open in one direction; and a rear roller connector in a rear end of each of the first and second frames, the rear roller connector being open in one direction.

The frame structure may further include a front roller unit connected to the front roller connector and a rear roller unit connected to the rear roller connector.

According to an embodiment of the present disclosure, a treadmill and a frame structure thereof can transfer a user's load to a side frame via a horizontal bar of a central frame and discharge the user's load outside the treadmill. Accordingly, the user's load is not concentrated on one portion of the treadmill, and therefore, the durability of the treadmill can be increased.

DETAILED DESCRIPTION

Figure 1:
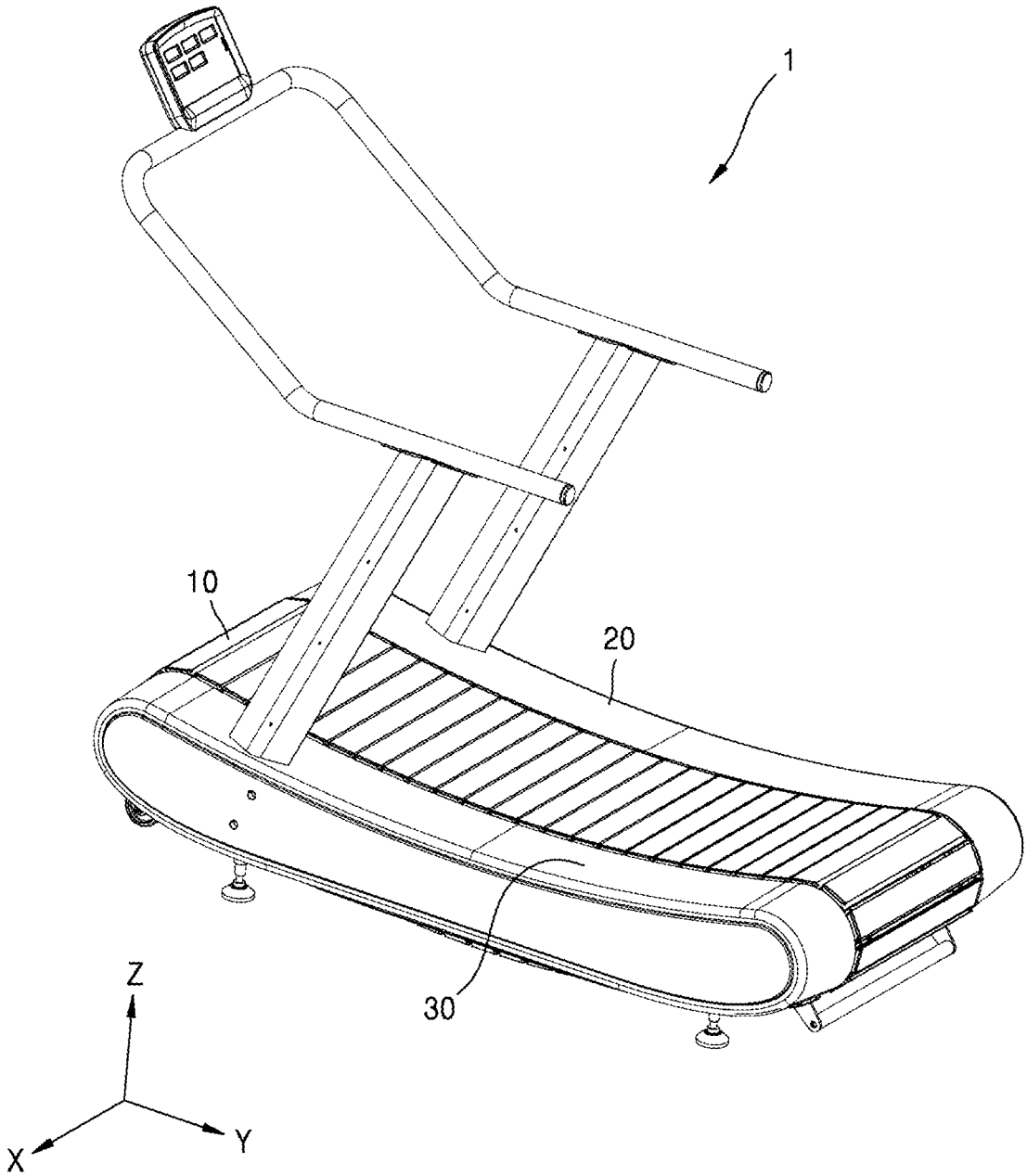
FIG. 1 is a perspective view of a treadmill according to an embodiment of the present disclosure.

Embodiments of the present disclosure will be described in detail hereinafter with reference to the accompanying drawings so as to be easily implemented by one of ordinary skill in the art to which the present disclosure belongs. The present disclosure may, however, be embodied in many different forms and is not limited to the embodiments set forth herein. Portions irrelevant to descriptions will be omitted from the drawings for clarity. In the drawings, like numbers refer to like elements throughout.

In the specification, when a portion is referred to as being "connected" or "coupled" to another portion, it may be "directly connected or coupled" to the other portion or may be "electrically connected" to the other portion with an intervening element therebetween. When a portion "comprises" or "includes" an element, it means that the portion may further comprise or include other elements and does not preclude the presence other elements unless stated otherwise.

FIG. 1 is a perspective view of a treadmill 1 according to an embodiment of the present disclosure.

Referring to FIG. 1, the treadmill 1 includes a plurality of slats 10, a first side cover 20, and a second side cover 30.

The slats 10 may extend in a first direction and may be arranged in a second direction perpendicular to the first direction. In FIG. 1, the first direction may be an X-axis direction and the second direction may be a Y-axis direction. When a user exercises on the treadmill 1, the slats 10 may be moved in the second direction by the user's leg motion.

The first and second side covers 20 and 30 are respectively provided at both sides of the slats 10 in a length direction thereof, i.e., in the first direction. The first and second side covers 20 and 30 may be provided to respectively cover first and second side frames 141 and 142 (see FIG. 2).

Figure 2:
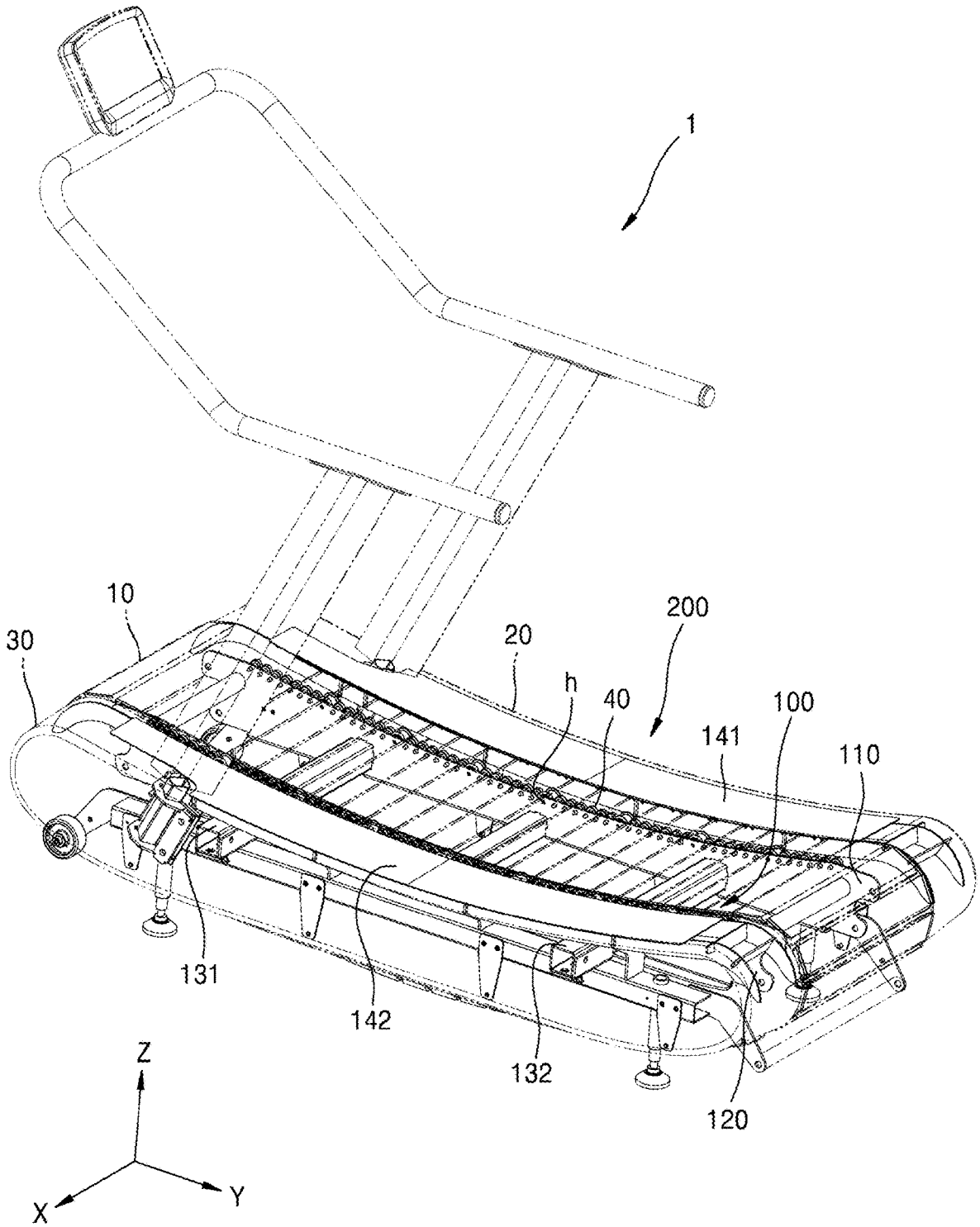
FIG. 2 is a perspective view of a treadmill according to an embodiment of the present disclosure.

FIG. 2 is a perspective view of the treadmill 1 according to an embodiment of the present disclosure.

Referring to FIG. 2, a frame structure 200 is provided inside the slats 10 and the first and second side covers 20 and 30. The frame structure 200 includes a central frame 100 (in FIG. 3) and the first and second side frames 141 and 142.

The frame structure 200 may support both ends of each of the slats 10 such that the slats 10 are movable in the second direction (i.e., the Y-axis direction).

Figure 3:
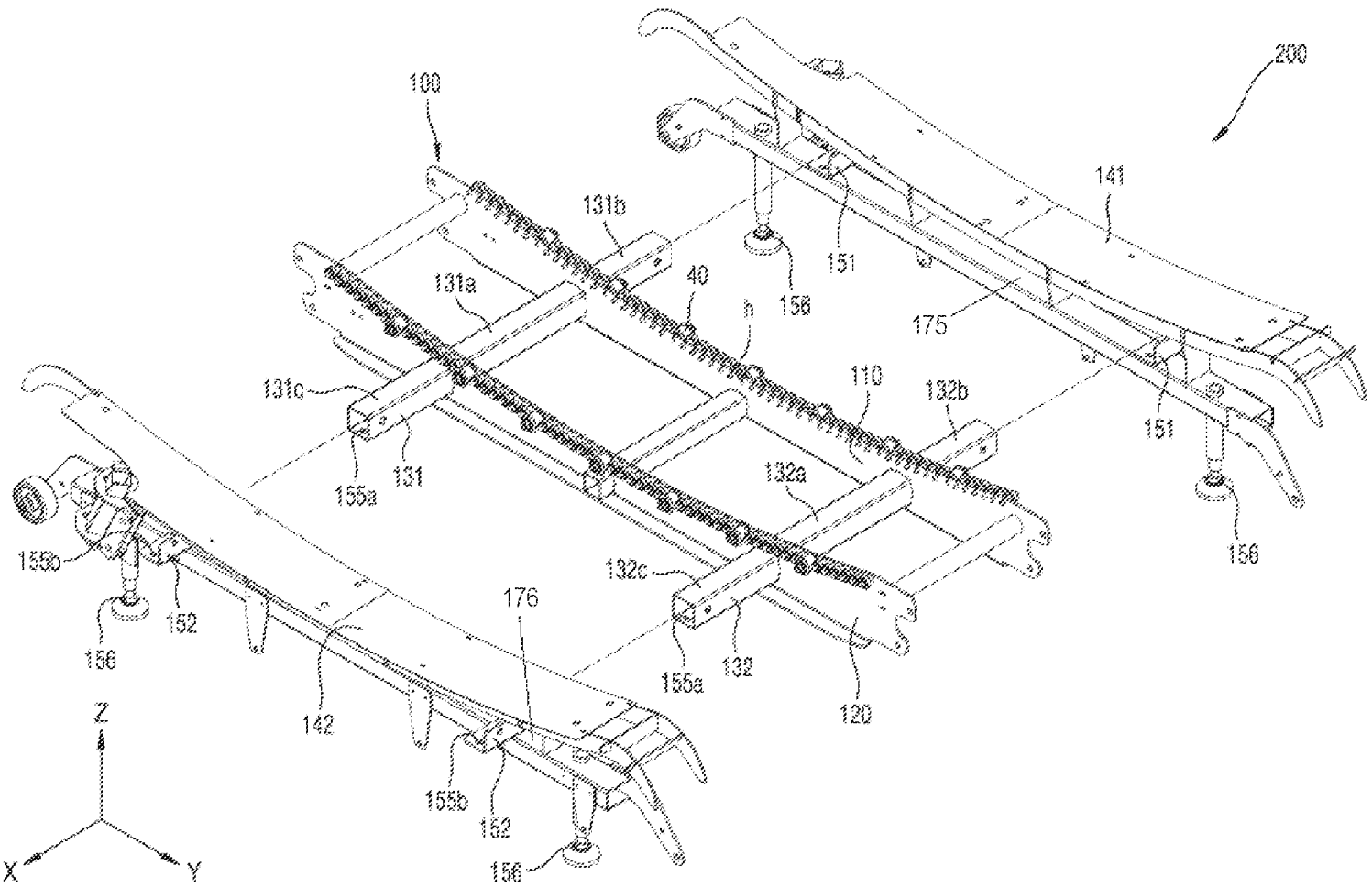
FIG. 3 is an exploded perspective view of a frame structure according to an embodiment of the present disclosure.
Figure 4:
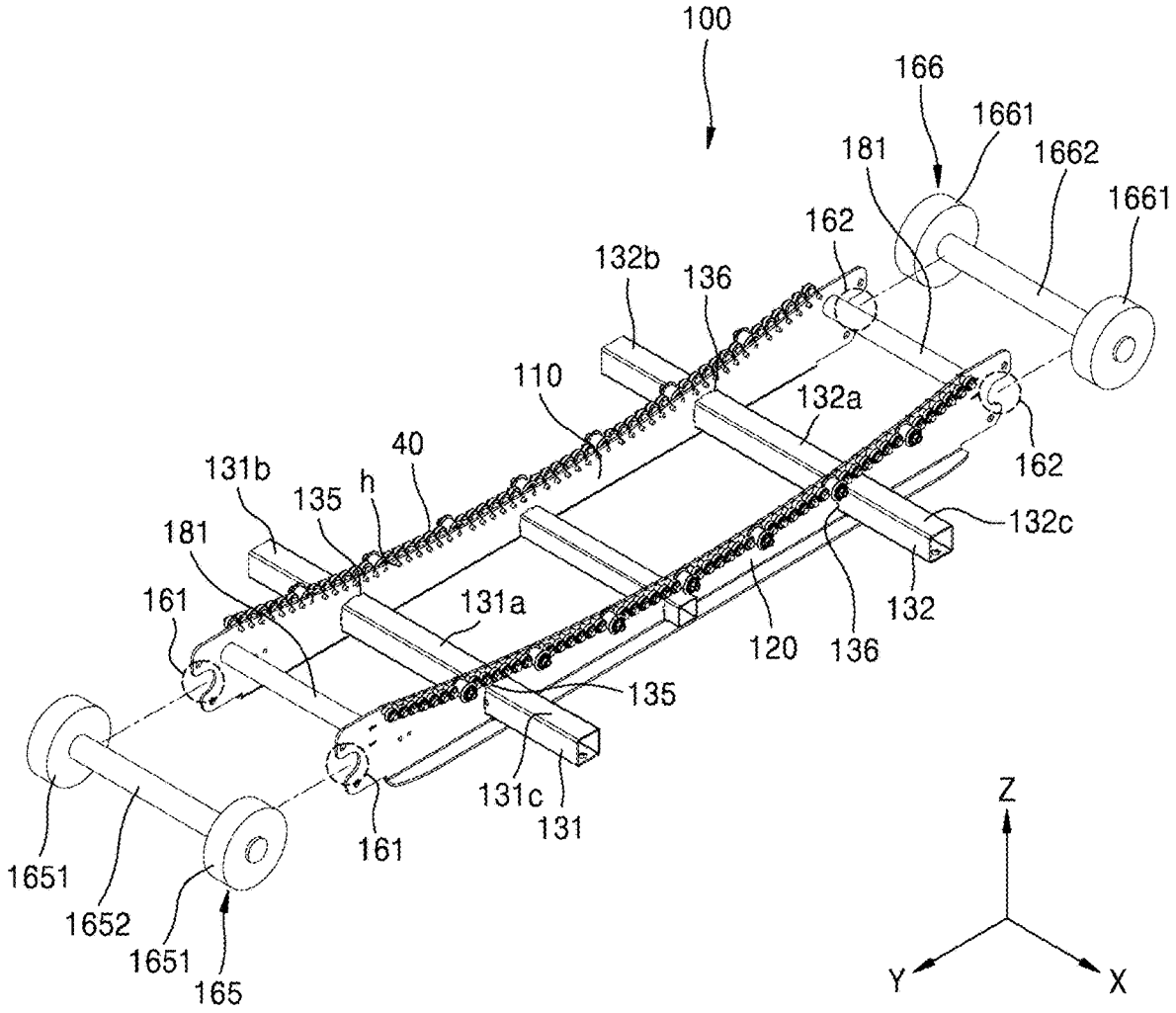
FIG. 4 is a perspective view of a central frame according to an embodiment of the present disclosure.

FIG. 3 is an exploded perspective view of the frame structure 200 according to an embodiment of the present disclosure. FIG. 4 is a perspective view of the central frame 100 according to an embodiment of the present disclosure.

Referring to FIGS. 3 and 4, the central frame 100 includes first and second frames 110 and 120, first and second horizontal bars 131 and 132, a bearing 40, a front roller connector 161, a rear roller connector 162, a front roller unit 165, and a rear roller unit 166.

The first and second frames 110 and 120 are separated from each other by a certain distance in a first direction. The first and second frames 110 and 120 may be arranged parallel to each other. The first direction is the same as the length direction of the slats 10 and may be the X-axis direction in FIG. 3.

A distance maintainer 181 may be arranged between the first and second frames 110 and 120. The length of the distance maintainer 181 may correspond to the distance between the first and second frames 110 and 120. Since the distance maintainer 181 is arranged between the first and second frames 110 and 120, the distance between the first and second frames 110 and 120 may be maintained.

The distance between the first and second frames 110 and 120 may be shorter than the length of the slats 10. The first and second frames 110 and 120 may include openings 135 and 136 through which the first and second horizontal bars 131 and 132 pass.

A top portion of each of the first and second frames 110 and 120 may have a concave curved shape. A plurality of holes "h" may be formed along the upper curved shape of the first and second frames 110 and 120. The bearing 40 may be provided in each of the holes "h".

The first and second horizontal bars 131 and 132 may extend in a direction in which the first and second frames 110 and 120 are separated from each other, i.e., in the first direction, and may penetrate the first and second frames 110 and 120 through the openings 135 and 136. The first and second horizontal bars 131 and 132 may be fixed to the first and second frames 110 and 120 using welding at the openings 135 and 136. The first and second horizontal bars 131 and 132 may extend longer than the distance between the first and second frames 110 and 120.

The first and second horizontal bars 131 and 132 may include first load regions 131*a* and 132*a*, respectively, second load regions 131*b* and 132*b*, respectively, and third load regions 131*c* and 132*c*, respectively. The first load regions 131*a* and 132*a* of the respective first and second horizontal bars 131 and 132 are arranged between the first and second frames 110 and 120. The second load regions 131*b* and 132*b* of the respective first and second horizontal bars 131 and 132 overlap the first side frame 141 and are connected and fixed to the first side frame 141. The third load regions 131*c* and 132*c* of the respective first and second horizontal bars 131 and 132 overlap the second side frame 142 and are connected and fixed to the second side frame 142. Although the number of the horizontal bars 131 and 132 is two in FIG. 3, the number of the horizontal bars 131 and 132 is not limited thereto. For example, one horizontal bar or at least three horizontal bars may be provided in the central frame 100.

The first and second side frames 141 and 142 may be respectively arranged at the respective outsides of the first and second frames 110 and 120. The first and second side frames 141 and 142 may include a plurality of legs 156, which transfer a load on the treadmill 1 to the outside. The frame structure 200 may also include a first lower support 175 disposed between the plurality of legs 156 and the first side frame 141, and a second lower support 176 disposed between the plurality of legs 156 and the second side frame 142. The first and second side frames 141 and 142 may respectively include positioning members 151 and 152. The positioning members 151 and 152 may have a shape that enables the first and second horizontal bars 131 and 132 to move in the first direction (i.e., the X-axis direction) and limits movement of the first and second horizontal bars 131 and 132 in the second direction (i.e., the Y-axis direction). For example, the positioning members 151 and 152 may have an L-shape. The positioning member 151 of the first side frame 141 may set the position of each of the second load regions 131*b* and 132*b* of the respective first and second horizontal bars 131 and 132. In other words, the first side frame 141 may be connected to each of the second load regions 131*b* and 132*b* of the respective first and second horizontal bars 131 and 132 via the positioning member 151.

The positioning member 152 of the second side frame 142 may set the position of each of the third load regions 131*c* and 132*c* of the respective first and second horizontal bars 131 and 132. In other words, the second side frame 142 may be connected to each of the third load regions 131*c* and 132*c* of the respective first and second horizontal bars 131 and 132 via the positioning member 152.

Each of the second load regions 131*b* and 132*b* and the third load regions 131*c* and 132*c* may include a fixing portion 155*a*, and each of the positioning members 151 and 152 may include a fixing portion 155*b*. The second load regions 131*b* and 132*b* and the third load regions 131*c* and 132*c* of the first and second horizontal bars 131 and 132 may be fixed to the positioning members 151 and 152 by connecting fixing members (not shown) to the fixing portions 155*a* and 155*b*.

In the current embodiment, the frame structure 200 has a shape, in which the second load regions 131*b* and 132*b* and the third load regions 131*c* and 132*c* of the central frame 100 are supported by the first and second side frames 141 and 142. Accordingly, when a user uses the treadmill 1 including the frame structure 200, the user's load may be transferred to the first and second frames 110 and 120 via the slats 10 and then to the first and second side frames 141 and 142 via the second load regions 131*b* and 132*b* and the third load regions 131*c* and 132*c* of the first and second horizontal bars 131 and 132 and then discharged outside the treadmill 1. In other words, the first load regions 131*a* and 132*a* respectively connect the second load regions 131*b* and 132*b* to the third load regions 131*c* and 132*c*, thereby dispersing the user's load. Accordingly, the durability of the treadmill 1 may be increased.

The front roller connector 161 may be provided in a front end of each of the first and second frames 110 and 120, and the rear roller connector 162 may be provided in a rear end of each of the first and second frames 110 and 120. The front roller connector 161 and the rear roller connector 162 may have a shape is opened along one direction. The front roller unit 165 may be connected to the front roller connector 161, and the rear roller unit 166 may be connected to the rear roller connector 162.

The front roller unit 165 includes a pair of front rollers 1651 arranged in the front and a front rotation shaft 1652 connecting the front rollers 1651 with each other. The rear roller unit 166 includes a pair of rear rollers 1661 arranged in the rear and a rear rotation shaft 1662 connecting the rear rollers 1661 with each other.

The front rotation shaft 1652 may be inserted into the front roller connector 161, and the rear rotation shaft 1662 may be inserted into the rear roller connector 162.

Here, the front and the rear are defined with respect to a user performing a normal exercise.

Since the front roller connector 161 and the rear roller connector 162 have a shape opened along one direction, assembling and separation of the front roller unit 165 and the rear roller unit 166 may be easy.

Figure 5:
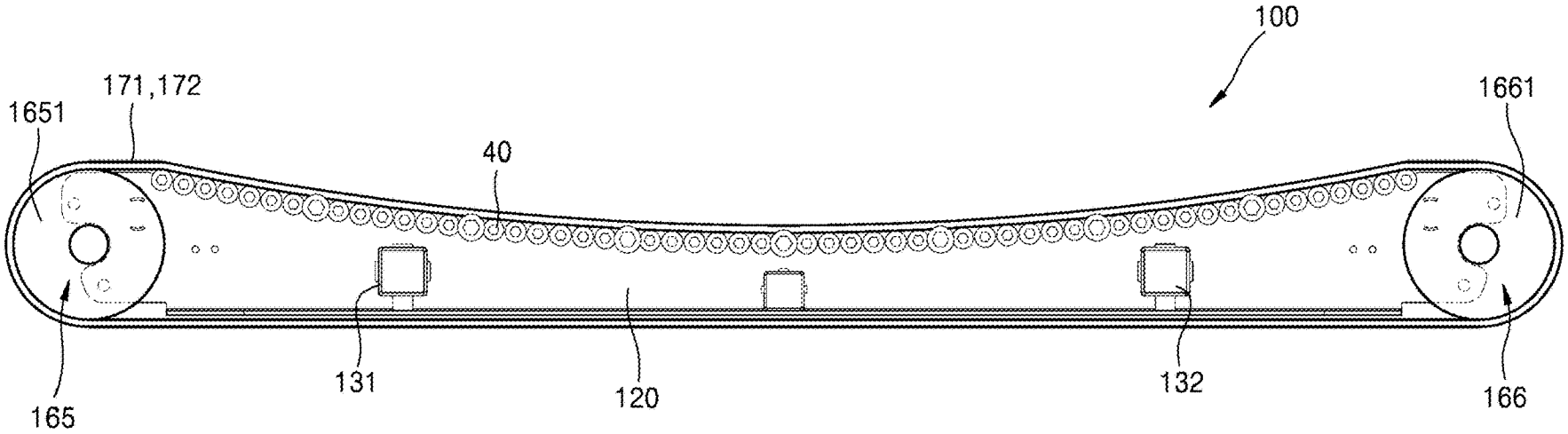
FIG. 5 is a side view of a central frame according to an embodiment of the present disclosure.

FIG. 5 is a side view of the central frame 100 according to an embodiment of the present disclosure.

A first belt 171 and a second belt 172 may be provided in contact with the front rollers 1651, the rear rollers 1661, and a plurality of bearings 40. The first and second belts 171 and 172 may have an endless shape. The first belt 171 may connect respective one ends of the slats 10 and the second belt 172 may connect respective opposite ends of the slats 10. The first and second belts 171 and 172 and the slats 10 fixedly connected to the first and second belts 171 and 172 may be rotated by the front rollers 1651, the rear rollers 1661, and the bearings 40. For example, the front rollers 1651, the rear rollers 1661, and the bearings 40 rotatably support the first and second belts 171 and 172, and accordingly, the slats 10 fixedly connected to the first and second belts 171 and 172 may be rotatably supported by the front rollers 1651, the rear rollers 1661, and the bearings 40.

Figure 6:
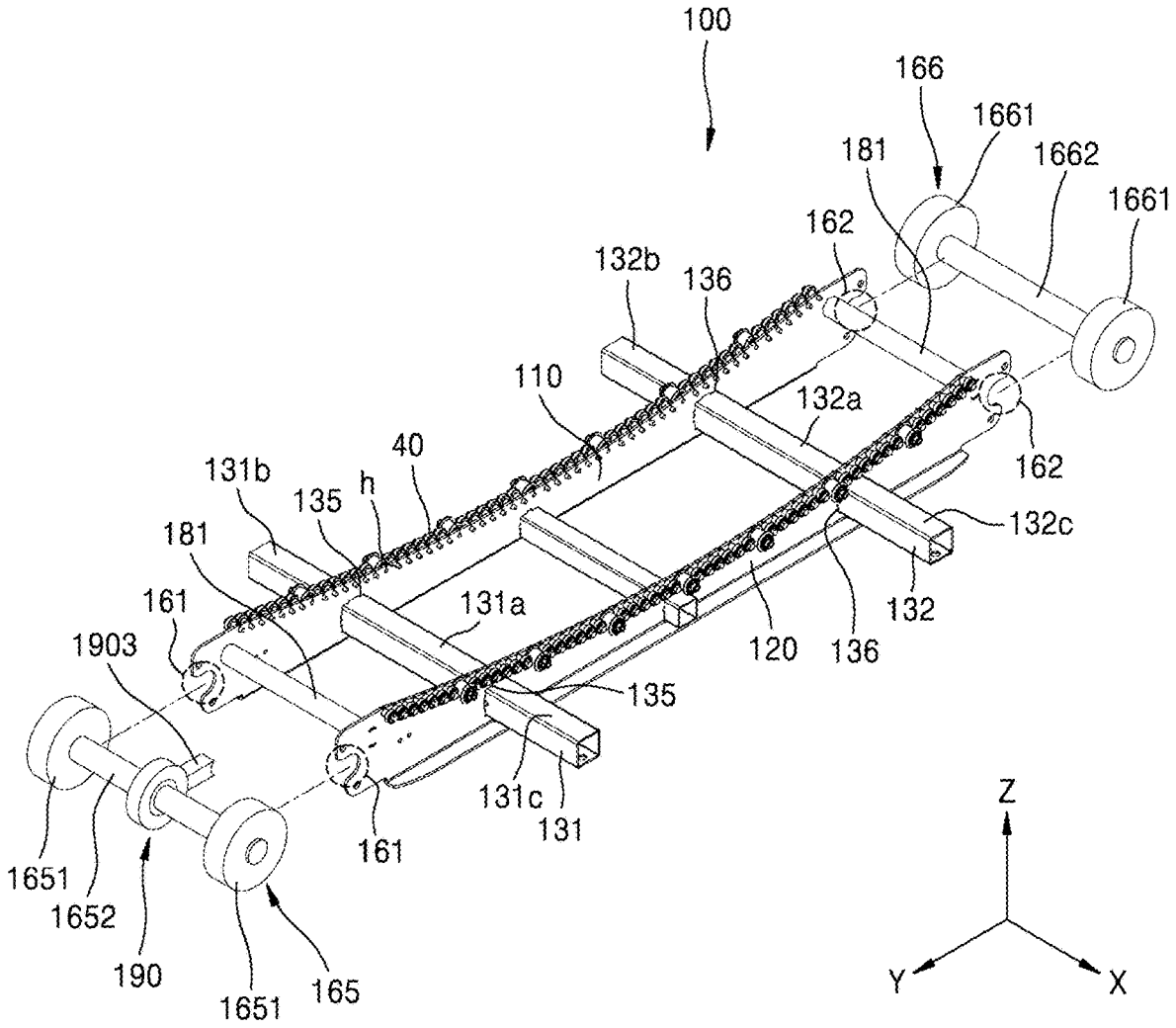
FIG. 6 is a perspective view of a central frame according to an embodiment of the present disclosure.
Figure 7A:
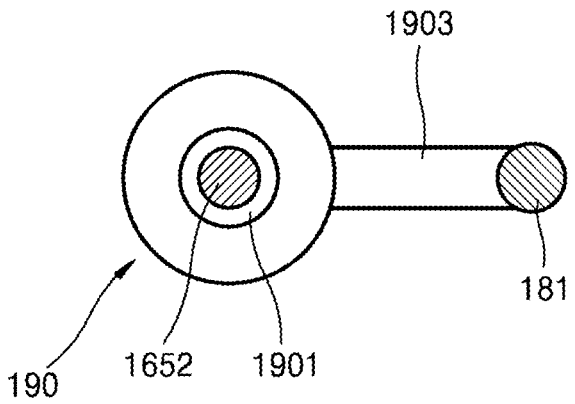
FIGS. 7A and 7B are diagrams for explaining a one-way bearing in FIG. 6.
Figure 7B:
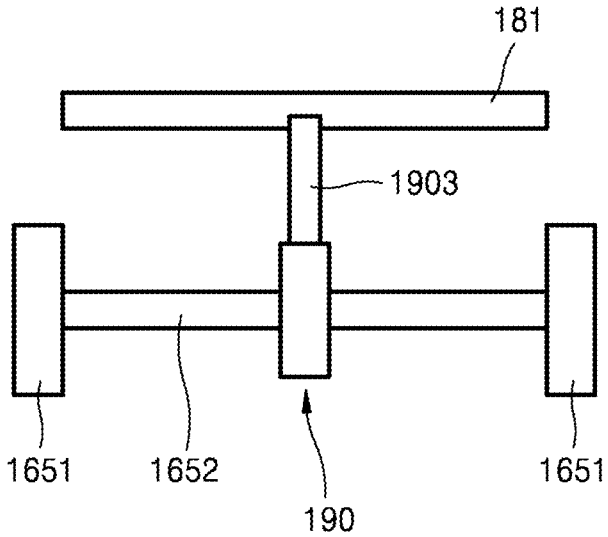

FIG. 6 is a perspective view of the central frame 100 according to an embodiment of the present disclosure. FIGS. 7A and 7B are diagrams for explaining a one way bearing 190 in FIG. 6. FIG. 7A is a diagram of the one way bearing 190 viewed from side, and FIG. 7B is a diagram of the one way bearing 190 viewed from above. In the description of the embodiments, like elements are denoted by like numbers. Redundant descriptions will be omitted.

Referring to FIGS. 6, 7A, and 7B, the central frame 100 may further include the one way bearing 190 to enable the treadmill 1 to rotate in one direction but to limit the rotation of the treadmill 1 in an opposite direction.

The front roller unit 165 is arranged in the front of the central frame 100, and the rear roller unit 166 is arranged in the rear of the central frame 100.

The one way bearing 190 may be rotatable in one direction but may limit a rotation in a different direction. For example, referring to FIG. 7A, the one way bearing 190 may be rotatable clockwise and may limit a counterclockwise rotation. Since the structure of the one way bearing 190 is well known, the detailed description of the structure will be omitted.

The front rotation shaft 1652 penetrates the one way bearing 190. For example, the front rotation shaft 1652 may be fixed to an inner diameter 1901 of the one way bearing 190. Accordingly, the front rollers 1651 are rotatable in one direction but limited with respect to a rotation in an opposite direction by way of the one way bearing 190. Due to the one way bearing 190, the slats 10 may be prevented from unintentionally moving forward when a user steps on or exercises on the treadmill 1.

The one way bearing 190 is arranged between the first frame 110 and the second frame 120. For example, the one way bearing 190 may be spaced apart from the first frame 110 and the second frame 120. The one way bearing 190 may be arranged in the middle between the first frame 110 and the second frame 120. The one way bearing 190 may be fixed to the distance maintainer 181. A fixing support 1903 may be arranged between the one way bearing 190 and the distance maintainer 181 to fix the one way bearing 190 to the distance maintainer 181. Accordingly, the inner diameter 1901 fixed to the front rotation shaft 1652 may be rotated while the one way bearing 190 is fixed to the distance maintainer 181.

When the one way bearing 190 is arranged biased to the first frame 110 or the second frame 120, for example, when the one way bearing 190 is fixed to the first frame 110 or the second frame 120, eccentricity occurs while the front rotation shaft 1652 is being braked by the one way bearing 190. In other words, one side of the front rotation shaft 1652 is braked by the one way bearing 190 while an opposite side of the front rotation shaft 1652 is stopped with a time delay since the one way bearing 190 is not present in the opposite side. Accordingly, the slats 10 may be twisted when braked, which may perturb a user. In addition, due to the eccentricity, the friction of the one way bearing 190 may increase. When the treadmill 1 is non-powered, an increase in the friction of the one way bearing 190 may cause a user discomfort.

In contrast, according to embodiments, the one way bearing 190 is arranged in the middle between the first frame 110 and the second frame 120, so that an increase in the friction of the one way bearing 190 due to eccentricity may be prevented and unbalanced braking of the slats 10 may be prevented. Accordingly, the durability of the treadmill 1 may be increased.

The embodiments described above are exemplary, and it will be understood by one of ordinary skill in the art to which the present disclosure belongs that the embodiments may be easily modified into other specific forms without changing the technical ideas or essential characteristics of the present disclosure. Accordingly, the embodiments described above should be considered as examples and not for purposes of limitation. For example, an element described as a single form may be implemented in a distributed fashion, and elements described as being distributed may be implemented in a combined form.

The scope of the embodiments is defined not by the detailed description above but by the appended claims. All changes or modifications drawn from the spirit and scope of the claims and their equivalent concept will be construed as being included in the scope of the embodiments.

What is claimed is:

1. A treadmill comprising:

a plurality of slats extending in a first direction and arranged in a second direction perpendicular to the first direction; and a frame structure configured to support both ends of each of the plurality of slats and configured to allow the plurality of slats to move in the second direction, wherein the frame structure comprises:

a first set of legs arranged along the second direction and configured to support the treadmill;

a second set of legs arranged along the second direction and spaced apart from the first set of legs in the first direction and configured to support the treadmill;

a first lower support placed over and supported by the first set of legs, the first lower support extending along the second direction;

a second lower support placed over and supported by the second set of legs, the second lower support extending along the second direction and spaced apart from the first lower support;

a first side frame placed over the first lower support;

a second side frame placed over the second lower support and spaced apart from the first side frame;

a first frame and a second frame extending in the second direction and disposed between the first side frame and the second side frame, the first frame including a first opening and the second frame including a second opening; and at least one horizontal bar extending in the first direction and configured to connect the first side frame, the first frame, the second frame and the second side frame in this order, the at least one horizontal bar penetrating the first and second frames through the first and second openings, wherein each of the at least one horizontal bar comprises:

a first load region interconnecting the first frame and the second frame;

a second load region placed over and fixed to the first lower support and placed under the first side frame, the second load region extending outwardly from the first frame; and a third load region placed over and fixed to the second lower support and placed under the second side frame, the third load region extending outwardly from the second frame.

2. The treadmill of claim 1, further comprising a distance maintainer arranged between the first frame and the second frame and configured to maintain the distance between the first frame and the second frame.

3. The treadmill of claim 2, further comprising:

a front roller unit is located at the front of the treadmill and including a pair of front rollers and a front rotation shaft connecting the pair of front rollers with each other;

a rear roller unit is located at the rear of the treadmill and including a pair of rear rollers and a rear rotation shaft connecting the pair of rear rollers with each other; and a one-way bearing arranged between the first frame and the second frame and supporting the front rotation shaft to allow the front rotation shaft to be rotatable in one direction but to limit rotation of the front rotation shaft in an opposite direction, the one-way bearing being fixed by the distance maintainer.

4. The treadmill of claim 3, wherein the one-way bearing is located at a center between the first frame and the second frame.

5. The treadmill of claim 1, wherein a top portion of each of the first and second frames has a concave curved shape, and wherein the treadmill further comprises a plurality of bearings disposed along the concave curved shape in each of the first and second frames.

6. The treadmill of claim 5, further comprising:

a first belt connecting respective ends of the plurality of slats, the first belt being moved by the plurality of bearings in the first frame; and a second belt connecting respective opposite ends of the plurality of slats, the second belt being moved by the plurality of bearings in the second frame.

7. The treadmill of claim 1, wherein the at least one horizontal bar is fixed to the first and second side frames using welding.

8. The treadmill of claim 1, wherein the first and second side frames respectively comprise positioning members respectively setting a position of the second load region and a position of the third load region.

9. The treadmill of claim 1, further comprising:

a first side cover covering the first side frame; and a second side cover covering the second side frame.

10. The treadmill of claim 1, wherein the plurality of slats are movable by a user's foot motion.

11. The treadmill of claim 1, wherein the at least one horizontal bar vertically overlaps i) the first side frame and the first lower support, and ii) the second side frame and the second lower support.

12. The treadmill of claim 1, wherein each of the second and third load regions comprises a top portion covered by the first or second side frame.

13. The treadmill of claim 1, wherein each of the second and third load regions comprises a bottom portion covered by the first or second lower support.

14. The treadmill of claim 1, wherein each of the second and third load regions crosses i) both of the first lower support and the first side frame, or ii) both of the second lower support and the second side frame.

15. A frame structure of a treadmill, wherein the frame structure supports a user's load and comprises:

a first set of legs arranged along a first direction and configured to support the treadmill;

a second set of legs arranged along the first direction with a gap from the first set of legs and configured to support the treadmill;

a first lower support placed over and supported by the first set of legs, the first lower support extending along the first direction;

a second lower support placed over and supported by the first set of legs, the first lower support extending along the first direction;

a first side frame placed over the first lower support;

a second side frame placed over the second lower support with a gap from the first side frame; and a first frame and a second frame arranged parallel to each other and located in the gap between the first side frame and the second side frame, the first frame including a first opening and the second frame including a second opening; and at least one horizontal bar extending perpendicularly to the first and second frames and configured to connect the first side frame, the first frame, the second frame and the second side frame in order, the at least one horizontal bar penetrating the first and second frames through the first and second openings, wherein each horizontal bar among the at least one horizontal bar comprises:

a first load region connecting between the first frame and the second frame;

a second load region placed over and fixed to the first lower support and placed under the first side frame; and a third load region placed over and fixed to the second lower support and placed under the second side frame.

16. The frame structure of claim 15, further comprising:

a front roller connector in a front end of each of the first and second frames, the front roller connector being open in one direction; and a rear roller connector in a rear end of each of the first and second frames, the rear roller connector being open in one direction.

17. The frame structure of claim 16, further comprising:

a front roller unit connected to the front roller connector; and a rear roller unit connected to the rear roller connector.

18. The frame structure of claim 17, further comprising a distance maintainer arranged between the first frame and the second frame and configured to maintain the distance between the first frame and the second frame.

19. The frame structure of claim 18, wherein the front roller unit is located at the front of the treadmill and includes a pair of front rollers and the front rotation shaft connecting the pair of front rollers with each other, wherein the rear roller unit is located at the rear of the treadmill and includes a pair of rear rollers and a rear rotation shaft connecting the pair of rear rollers with each other, and wherein the frame structure further comprises a one-way bearing arranged between the first frame and the second frame and supporting a front rotation shaft to allow the front rotation shaft to be rotatable in one direction but to limit a rotation of the front rotation shaft in an opposite direction, the one-way bearing being fixed by the distance maintainer.

20. The frame structure of claim 19, wherein the one-way bearing is in a center between the first frame and the second frame.

21. The frame structure of claim 15, wherein a top portion of each of the first and second frames has a concave curved shape.

* * * * *